US007416000B2

(12) United States Patent
White et al.

(10) Patent No.: US 7,416,000 B2
(45) Date of Patent: Aug. 26, 2008

(54) APPARATUS FOR STRAIGHT-LINING CONSTRUCTION MATERIAL

(76) Inventors: Larry White, 228 Lambro La., Franklin Furnace, OH (US) 45629; Roger Carmichael, 317 Lambro La., Franklin Furnace, OH (US) 45629

( * ) Notice: Subject to any disclaimer, the term of this patent is extended or adjusted under 35 U.S.C. 154(b) by 216 days.

(21) Appl. No.: 11/376,948

(22) Filed: Mar. 16, 2006

(65) Prior Publication Data

US 2007/0215246 A1 Sep. 20, 2007

(51) Int. Cl.
*B27B 31/00* (2006.01)
*B27C 1/12* (2006.01)
*B27C 5/02* (2006.01)

(52) U.S. Cl. ..... 144/253.3; 144/253.1; 144/278.1

(58) Field of Classification Search ..... 144/253.1, 144/253.3, 253.4, 253.6, 204.2, 198.1, 278.1; 269/303, 249, 297; 83/435.11–435.27, 438, 83/477.2, 277

See application file for complete search history.

(56) References Cited

U.S. PATENT DOCUMENTS

| | | | | | |
|---|---|---|---|---|---|
| 3,389,725 | A | | 6/1968 | Tidwell | |
| 3,958,339 | A | | 5/1976 | Thornell | |
| 4,367,668 | A | | 1/1983 | Jensen | |
| 4,432,263 | A | * | 2/1984 | Kowalchuk | 83/438 |
| 4,469,318 | A | | 9/1984 | Slavic | |
| 4,481,846 | A | * | 11/1984 | Goodell | 83/438 |
| 4,593,590 | A | * | 6/1986 | Gray | 83/438 |
| 4,628,782 | A | | 12/1986 | Park | |
| 4,817,482 | A | * | 4/1989 | Dunaway et al. | 83/438 |
| 5,020,578 | A | | 6/1991 | Jennings | |
| 5,058,474 | A | | 10/1991 | Herrera | |
| 5,113,734 | A | | 5/1992 | Mahler | |
| 5,176,058 | A | * | 1/1993 | Skelly | 83/415 |
| 5,181,446 | A | | 1/1993 | Theising | |
| 5,228,374 | A | | 7/1993 | Santeramo, Sr. | |
| 5,460,070 | A | | 10/1995 | Buskness | |
| 5,647,258 | A | | 7/1997 | Brazell et al. | |
| 5,722,308 | A | | 3/1998 | Ceroll et al. | |
| 5,740,711 | A | | 4/1998 | Ramirez | |
| 5,809,857 | A | | 9/1998 | Owen | |
| 5,823,084 | A | | 10/1998 | Ramey | |
| D404,404 | S | | 1/1999 | Lane et al. | |
| 5,918,520 | A | | 7/1999 | Whitcomb | |
| 5,927,857 | A | | 7/1999 | Ceroll et al. | |
| 6,148,703 | A | | 11/2000 | Ceroll et al. | |
| 6,311,828 | B1 | | 11/2001 | Newnes et al. | |
| 6,360,641 | B1 | | 3/2002 | Talesky et al. | |
| 6,360,642 | B1 | | 3/2002 | Miller et al. | |
| 6,460,442 | B2 | | 10/2002 | Talesky et al. | |
| 6,578,461 | B1 | | 6/2003 | Loo | |
| 6,708,593 | B1 | | 3/2004 | Weselyk | |

(Continued)

*Primary Examiner*—Bena Miller
(74) *Attorney, Agent, or Firm*—Waters Law Group PLLC; Robert R. Waters; Olen L. York, III.

(57) ABSTRACT

An apparatus for straight-lining construction material comprises an extension coupled to a rip fence and a carrier assembly coupled to the top of the extension, in which the carrier assembly travels along the extension to deliver the material to a saw blade. The carrier assembly comprises a sled, a plurality of clamp assemblies and a guide, the sled and the plurality of adjustable clamp assemblies coupled to the guide. The guide has a recess receiving the extension. Each one of the plurality of clamp assemblies secures the material in position.

39 Claims, 9 Drawing Sheets

U.S. PATENT DOCUMENTS

| | | | | |
|---|---|---|---|---|
| 6,715,390 | B1 * | 4/2004 | Flader | 83/438 |
| 6,851,345 | B1 | 2/2005 | Kennelly et al. | |
| 6,899,004 | B1 | 5/2005 | Miller | |
| 2002/0078810 | A1 | 6/2002 | Taleskv et al. | |
| 2002/0088325 | A1 | 7/2002 | Taleskv et al. | |
| 2002/0157515 | A1 | 10/2002 | Dick | |
| 2005/0139056 | A1 | 6/2005 | Gass et al. | |
| 2005/0172772 | A1 | 8/2005 | Ceroll et al. | |
| 2005/0172773 | A1 | 8/2005 | Ku et al. | |

* cited by examiner

APPARATUS FOR STRAIGHT-LINING CONSTRUCTION MATERIAL

RELATED U.S. APPLICATION DATA

Not applicable.

FIELD OF THE INVENTION

This invention relates to a new and useful guide for use with a circular blade table saw to provide a straight-line cut longitudinally through solid material, including raw lumber or wood, plastic, cardboard, polystyrene (i.e. STYROFOAM®) or other similar materials, and especially for material having the general shape of a board or plank.

BACKGROUND OF THE INVENTION

When preparing construction material for refined uses, it is often necessary to impart a straight longitudinal and square edge on an otherwise non-square and bowed longitudinal edge. The process of imparting a straight longitudinal and square edge onto construction material (such as raw lumber or wood) is generally referred to as "straight-lining".

There are many devices and apparatuses that have been employed to straight-line lumber or wood boards or planks, ranging from crude and simple solutions to sophisticated machinery. However, these varied attempts collectively suffer from several drawbacks, including causing invasive damage to the material, inefficiency, complexity of use, and expense of purchasing particular machines and/or components to successfully straight-line material.

Among the simple solutions offered is U.S. Pat. No. 3,587,680 (issued to Bishop), which describes a guide means having fastening means for attaching the guide means to an unfinished wood board. The fastening means is specifically described as nails, wherein the nails are driven through the guide means and into the unfinished wood board. The guide means is aligned in a specified manner so as to create a straight-line edge along which the circular saw will cut, and thus creating the desired straight-line. However, the use of nails (or other similar means) requires that the means penetrates the unfinished board, thereby unnecessarily damaging the board. In addition, driving the individual nails requires time and effort that might be better utilized.

Another simple solution is described in U.S. Pat. No. 4,026,175 (issued to Bisey), in which an alignment bar (having a square edge) is aligned with a line that indicates a path for creating a straight-line on the board. A pencil or another utensil must be used to create such a guide line. This alignment tool is useful for straight-lining relatively short boards. Marking longer boards with pencil lines is cumbersome and subject to considerable marking error.

More recently, and as disclosed in U.S. Pat. No. 5,113,734 (issued to Mahler), a straight edge ripping guide for uneven boards is described having an elongated guide piece. The guide has a push-stop member positioned perpendicular to the guide piece, and at one end thereof, and with pin points for impaling the board therein. The guide piece travels along and abuts against the standard rip fence provided on the table saw. However, this invention also damages the board (along the end edges). The board may become dislodged from the pin points if some movement of the board is experienced. In addition, the apparatus requires precision operation by the user in following a truly linear path along the rip fence.

Another similar apparatus is found in U.S. Pat. No. 5,823,084 (issued to Ramey), which discloses a tool used for straight-lining wood comprising an elongated clamp base having a straight longitudinal edge and at least one toggle clamp assembly affixed to the base so as to clamp down and secure the board to the base, and further having an extension base and bar for attachment to the base and a toggle clamp attached to the extension base. This invention suffers from the problem of having to rely upon the user to follow a precise linear path utilizing one longitudinal edge of the base and the rip fence. This invention also requires the addition of the extension to lengthen the apparatus for longer lengths of board.

SUMMARY OF THE INVENTION

In one embodiment of the present invention, an apparatus for straight-lining construction material comprises an extension coupled to a rip fence and a carrier assembly coupled to the top of the extension, in which the carrier assembly travels along the extension to deliver the material to a saw blade. The carrier assembly comprises a sled, a plurality of clamp assemblies and a guide, the sled and the plurality of adjustable clamp assemblies coupled to the guide. The guide has a recess receiving the extension. Each one of the plurality of clamp assemblies secures the material in position.

In another embodiment of the present invention, an apparatus for straight-lining construction material comprises an extension coupled to a rip fence and a carrier assembly coupled to the top of the extension, in which the carrier assembly travels along the extension to deliver the material to a saw blade. The carrier assembly comprises a sled, a plurality of clamp assemblies and a guide, the sled and the plurality of adjustable clamp assemblies coupled to the guide. The guide has a recess and a plurality of rollers within the recess, and the recess receiving the extension therein. The sled has a base element coupled to an upstanding element, and a plurality of rollers on the underside of the base element. Each one of the plurality of clamp assemblies has an arm, and the arm is coupled to the guide and the upstanding element and has an adjustable clamp at a free end.

In another embodiment of the present invention, an apparatus for straight-lining material comprises an extension coupled to a rip fence and a carrier assembly coupled to the top of the extension, in which the carrier assembly travels along the extension to deliver the material to a saw blade. The carrier assembly comprises a sled, a plurality of clamp assemblies and a guide, with the sled and the plurality of adjustable clamp assemblies coupled to the guide. The guide has a recess and a plurality of rollers within the recess, with the recess receiving the extension therein. The sled has a base element coupled to an upstanding element, and a plurality of rollers on the underside of the base element. Each one of the plurality of clamp assemblies has an arm, the arm coupled to the guide and the upstanding element at one end and having an adjustable clamp at an opposing end for securing the material in position. Each one of the plurality of clamp assemblies is laterally and vertically adjustable.

In each of the aforementioned embodiments, the extension may have a pair of parallel and linearly elongated members and a plank intermediately disposed therebetween, and with the extension forming a track for the carrier assembly. In another embodiment, the extension may have an angled member, a linearly elongated member and a plank intermediately disposed between the angled member and the linearly elongated member, wherein the angled member has a horizontal portion and a vertical portion, in which the horizontal portion is coupled to the rip fence and the extension forms a track for the carrier assembly. In either embodiment of the extension, or in other possible embodiments, at least one of the elongated members of the extension may have a minimal frictional resistance strip aligned parallel to the elongated members and engages the rollers of the guide.

In each of the aforementioned embodiments, it is envisioned that the carrier assembly may have at least one handle coupled thereto to facilitate ease of operation by the user. It is envisioned that a plurality of handles may be provided thereon. The handle or handles may be placed in a variety of positions to achieve these ends.

Additionally, in each of the aforementioned embodiments, each one of the clamp assemblies may further comprise a channel bar coupled to the guide and a complimentary slide bar removably coupled to the channel bar. The slide bar has a threaded fastener for securing the slide bar into a position. The slide bar depends from an end of the arm and opposite of the adjustable clamp. In another embodiment, each one of the clamp assemblies may comprise a toggle clamp assembly having the arm extending over the sled and a bolt assembly operatively coupled to the arm for securing the material in position. In either embodiment of the clamp assemblies, the clamp assemblies may be vertically and/or laterally adjustable, as desired.

As discussed above, the method and device of the present invention overcomes the disadvantages inherent in prior art methods and devices. In this respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Accordingly, those skilled in the art will appreciate that the conception upon which this invention is based may readily be utilized as a basis for the design of other structures, methods, and systems for carrying out the several purposes of the present invention. It is important, therefore, that the claims be regarded as including such equivalent constructions insofar as they do not depart from the spirit of the present invention.

Furthermore, the purpose of the foregoing Abstract is to enable the U.S. Patent and Trademark Office and the public generally, and especially including the practitioners in the art who are not familiar with patent or legal terms or phraseology, to determine quickly from a cursory inspection, the nature and essence of the technical disclosure of the application. The Abstract is neither intended to define the invention of the application, nor is it intended to be limiting to the scope of the invention in any way. It is intended that the application is defined by the claims.

BRIEF DESCRIPTION OF THE DRAWINGS

Additional utility and features of the invention will become more fully apparent to those skilled in the art by reference to the following drawings, which illustrate the primary features of the preferred embodiment and numerous alternative embodiments.

DETAILED DESCRIPTION OF THE PREFERRED EMBODIMENT

The detailed description below is for preferred embodiments and is intended to explain the current invention. It is to be understood that a variety of other arrangements are also possible without departing from the spirit and scope of the invention.

Figure 1:
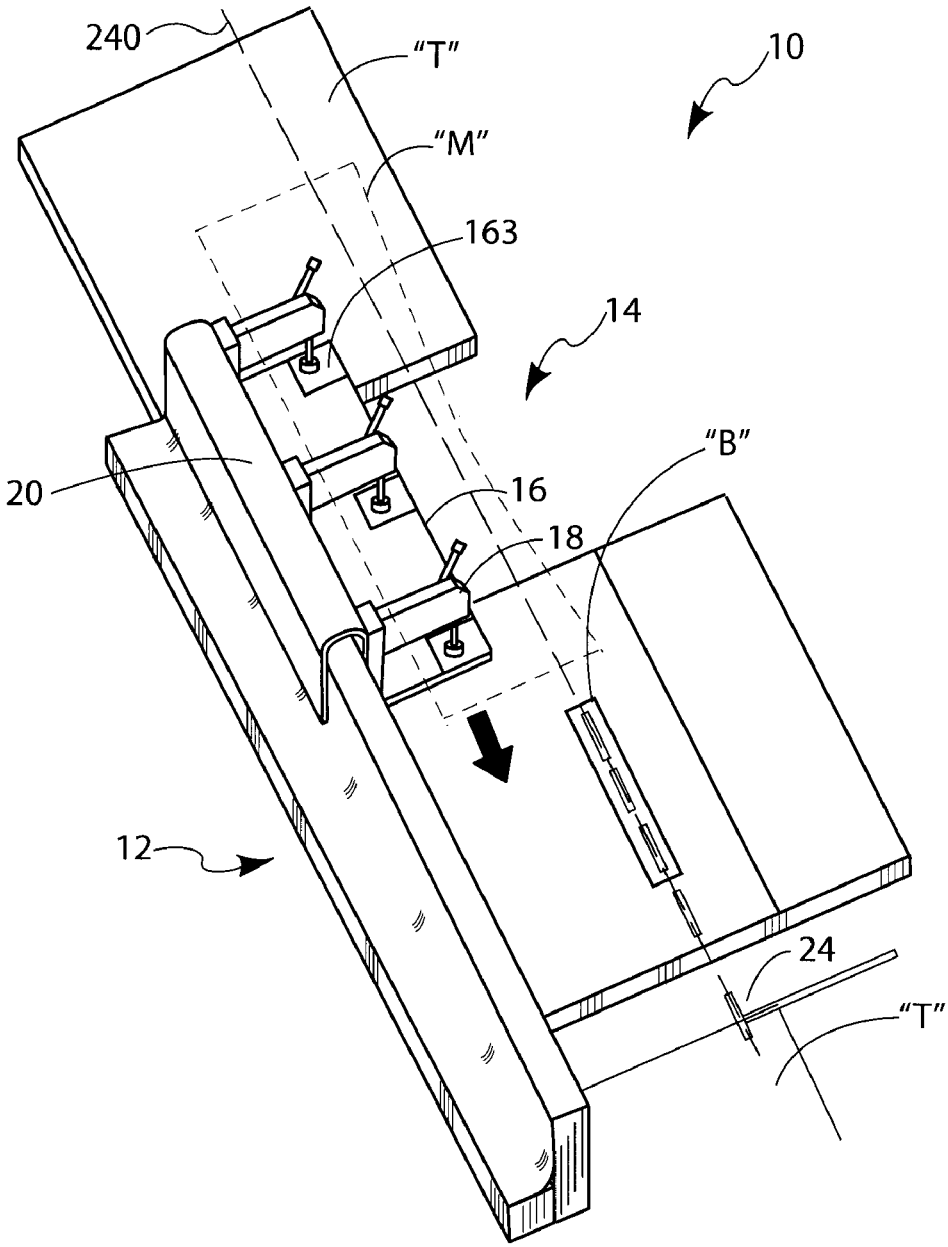
FIG. 1 is a perspective view of the straight-line apparatus for cutting straight edges on construction material described herein.
Figure 2:
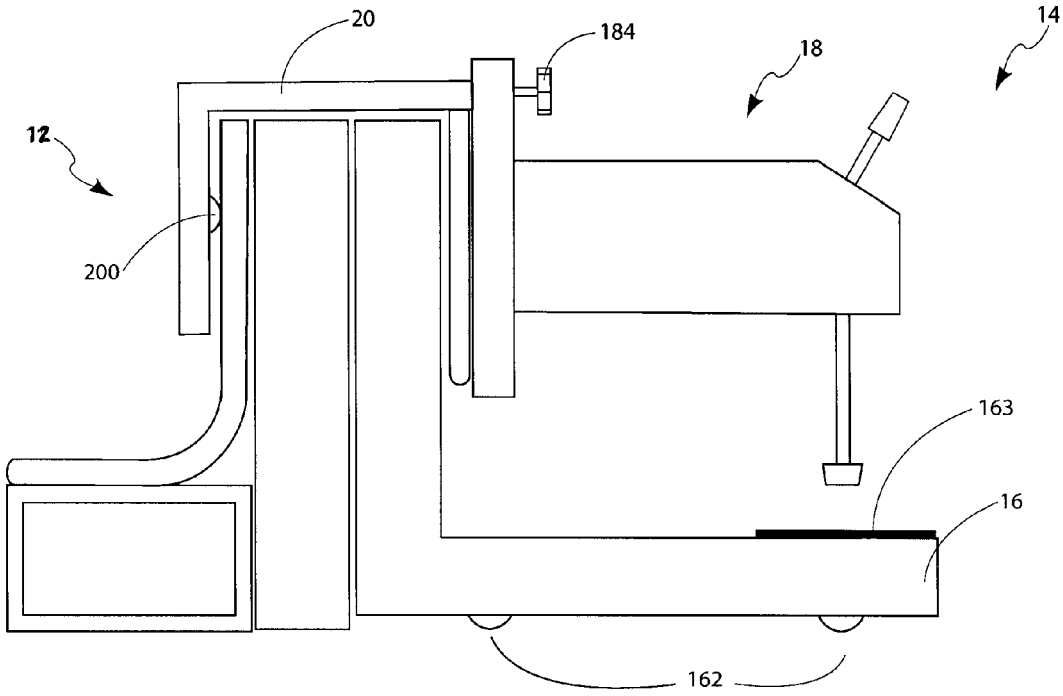
FIG. 2 is a front or rear view of the apparatus depicted in FIG. 1.

Referring now to FIG. 1 and FIG. 2, an apparatus for straight-lining construction material, generally denoted by the reference numeral 10, is disclosed and described in accordance with one embodiment of the present invention. The apparatus 10 comprises an extension 12 coupled to a rip fence F and a carrier assembly 14 coupled to the top of the extension 12, in which the carrier assembly 14 traveling along the extension 12 to deliver the material M to a saw blade B. The carrier assembly 14 comprises a sled 16, a plurality of clamp assemblies 18 and a guide 20, the sled 16 and the plurality of adjustable clamp assemblies 18 coupled to the guide 20. The guide 20 has a recess 22 receiving the extension 12. Each one of the plurality of clamp assemblies 18 securing the material M in position.

Figure 4:
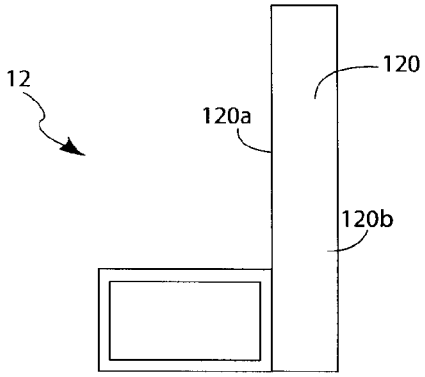
FIG. 4 is a front or rear view of one embodiment of the extension.
Figure 5:
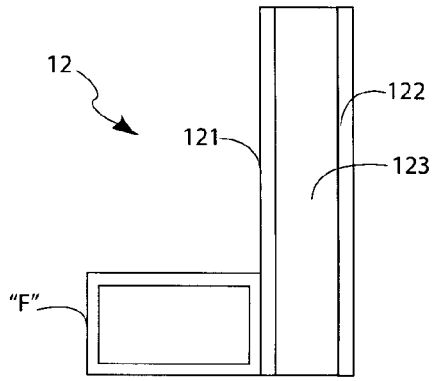
FIG. 5 is a front or rear view of another embodiment of the extension.
Figure 6:
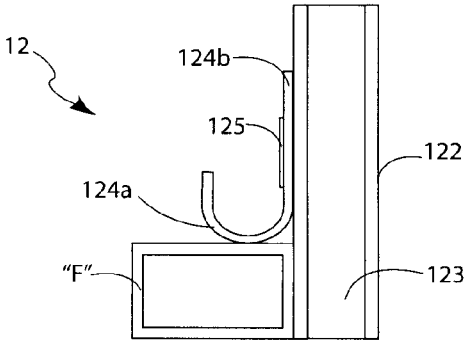
FIG. 6 is a front or rear view of another embodiment of the extension.
Figure 7:
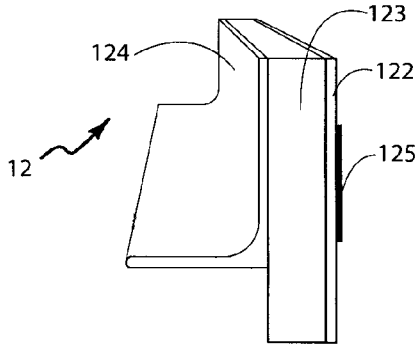
FIG. 7 is a front or rear view of another embodiment of the extension.

In one embodiment, as depicted in FIG. 4, the extension 12 may comprise a linearly elongated member 120 forming a track for the carrier assembly 14, and wherein the guide 20 may be coupled to the top portion of the member 120 (which operates as the track). In another embodiment, as depicted in FIG. 5, the extension 12 may have a pair of parallel and linearly elongated members 121 and 122 and a plank 123 intermediately disposed therebetween, the extension 12 forming a track for the carrier assembly 14. In another embodiment, as depicted in FIG. 6 and FIG. 7, the extension 12 may comprise an elongated and angled member 124, a linearly elongated member 122 and a plank 123 intermediately disposed between the angled member 124 and the linearly elongated member 122. The extension 12 forms a track for the carrier assembly 14. The angled member 124 has a horizontal portion 124*a* and a vertical portion 124*b*, in which the horizontal portion 124*a* is or may be coupled to the rip fence F.

Figure 8:
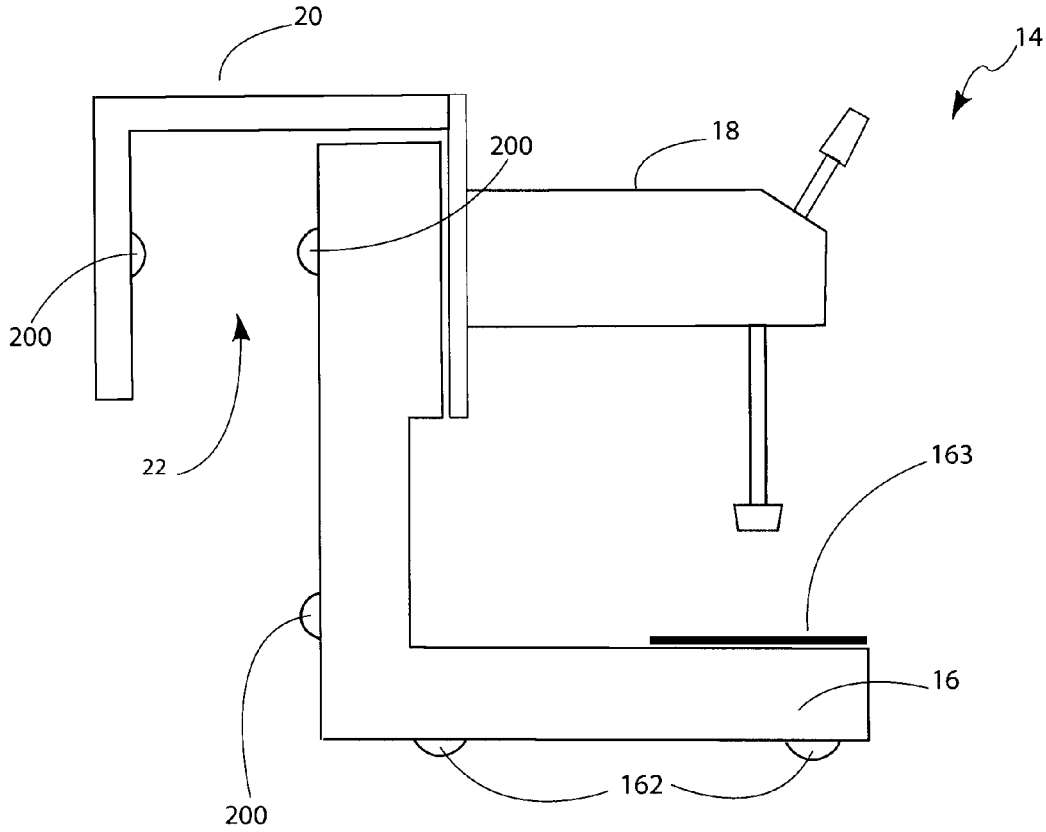
FIG. 8 is a front or rear view of one embodiment of the carrier assembly.
Figure 9:
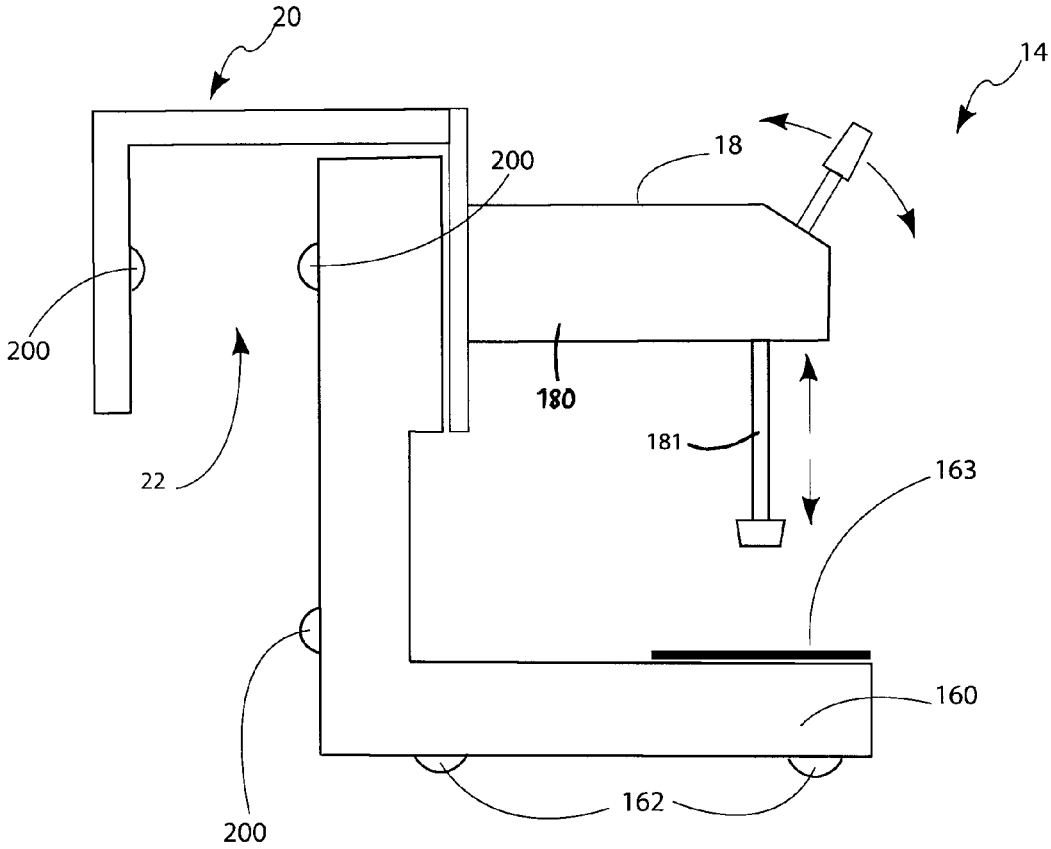
FIG. 9 is a front or rear view of another embodiment of the extension.

The member 120 (see FIG. 4), or the coupling of members 121, 122 and plank 123 (see FIG. 5, FIG. 6 or FIG. 7), or the coupling of members 124, 122 and the plank 123, has a thickness sufficient so that one surface 120*a* (or 121*a* or 124*a*) is adjacent to and in spaced relation to an external portion of the guide 20, and so tat the opposing surface 120*b* (or 122*a*) is adjacent to and in spaced relation to an internal portion of the guide 20 (see FIG. 8). In another embodiment the opposing surface 120*a* (or 121*a* or 124*a*) may lie adjacent to and in spaced relation to an upstanding element 161 of the sled 12 (see FIG. 9), wherein the opposing surface 120*b* (or 122*a*) and the upstanding member 161 communicate and have minimal frictional resistance therebetween. At least one surface 120*a* (or 121*a* or 124*b*) or 120*b* (or 122*a*) has a low or minimal frictional resistance strip 125 aligned parallel to the member 120 or the members 121, 122 and/or 124. The strip 125 engages the rollers 200 (such as ball bearings) of the guide 20. The strip 125 may comprise a variety of materials, including polypropylene, laminated material (such as MASONITE®), silicon-based material, or any other suitable material capable of providing a low frictional resistant surface.

The elongated member 120 or members 121, 122 and/or 124, and the plank 123, may each comprise a variety of materials, including aluminum, steel, MDF, polypropylene, acrylic and/or other suitable materials capable of providing a rigid, durable member with the strength to withstand repeated usage of the apparatus 10. It is envisioned that the member 120 or members 121, 122 and/or 124, and the plank 123, may comprise a length between five and twelve feet. In one embodiment, the member 120 or members 121, 122 and/or 124, and the plank 123 may have a length of approximately nine feet.

Figure 17:
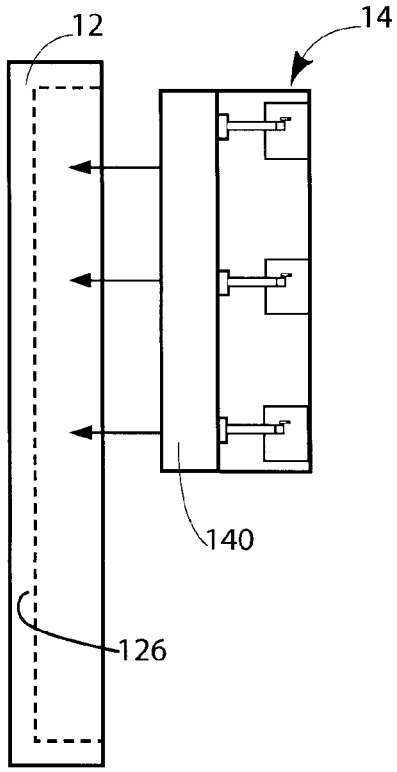
FIG. 17 is a top view of an alternate embodiment of the extension and the carrier assembly.
Figure 18:
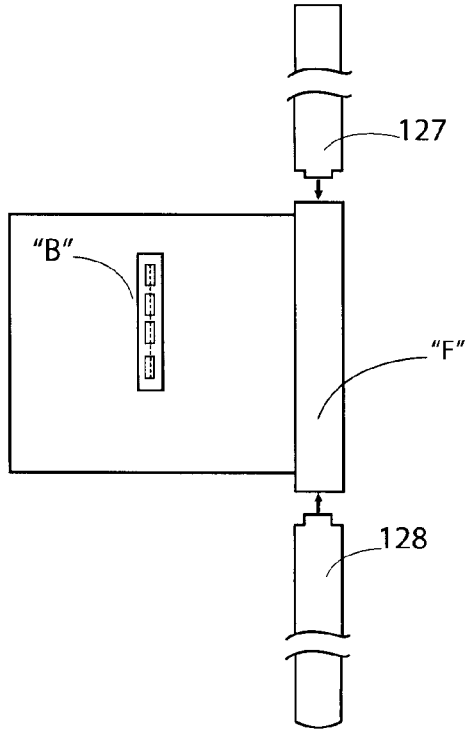
FIG. 18 is a top view of another embodiment of the extension.

In another embodiment, as depicted in FIG. 17, the extension 12 has a slot 126 formed along a path parallel to the axial direction of the extension 12. The slot 126 is provided to receive and accommodate an elongated insert 140 depending from the carrier assembly 14, thereby providing a means for coupling the extension 12 and the carrier assembly 14, and permitting the carrier assembly 14 to follow a linear and accurate pathway by which the material M is urged to engage the saw blade B and to achieve a straight-line cut in the material M.

Figure 10:
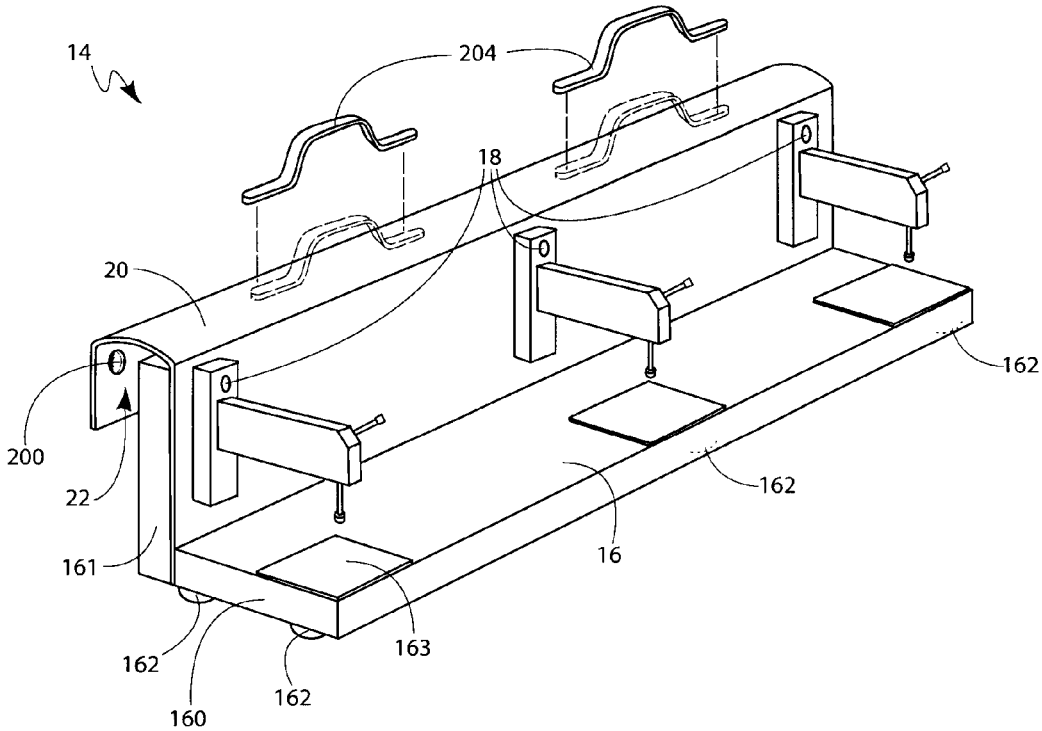
FIG. 10 is a perspective view of one embodiment of the carrier assembly.

Referring now to FIG. 10, the sled 16 supports the material M as the material M is transported to and through the saw blade B. The sled 16 may have a plurality of rollers 162 on an underside of the sled 16. The sled may have a plurality of gripping surfaces 163 mounted or attached on the top surface of the sled 16, with each gripping surface 163 corresponding to the position of each one of the adjustable clamp assemblies 18, thus operating in securing the material M into position. The gripping surfaces 163 may be formed of any material that is capable of inhibiting lateral and longitudinal movement of the material M once the clamp assembly 18 is secured against the material M. For instance, the gripping surfaces 163 may be formed of a material similar to that of sanding paper (including all grits of sand paper commercially available), or other abrasive surface material such as a tungsten surface.

In one embodiment, as depicted in FIG. 10, the sled 16 comprises a base element 160 and upstanding element 161, the base element 160 coupled to the upstanding element 161. The base element 160 may include a plurality of rollers 162 on the underside of the base element 160. The rollers 162 may comprise a variety of objects that are capable of transporting the sled 16 (and base element 161) over the bench and table portions T of a table saw and toward the saw blade B. In one embodiment, the rollers 162 may comprise roller (bearing) balls. It is envisioned that the number of roller (bearing) balls may exceed four, and it is anticipated that the range will fall between four and sixteen. Other rollers 162 may include a plurality of cylinders that are aligned parallel to one another (similar to a roller frame used for transporting boxes or other material over short distances, such as for deliveries), skates, wheels, or other similar objects. In this configuration, the base element 160 supports the gripping surface(s) 163 described in the previous paragraph.

Figure 3:
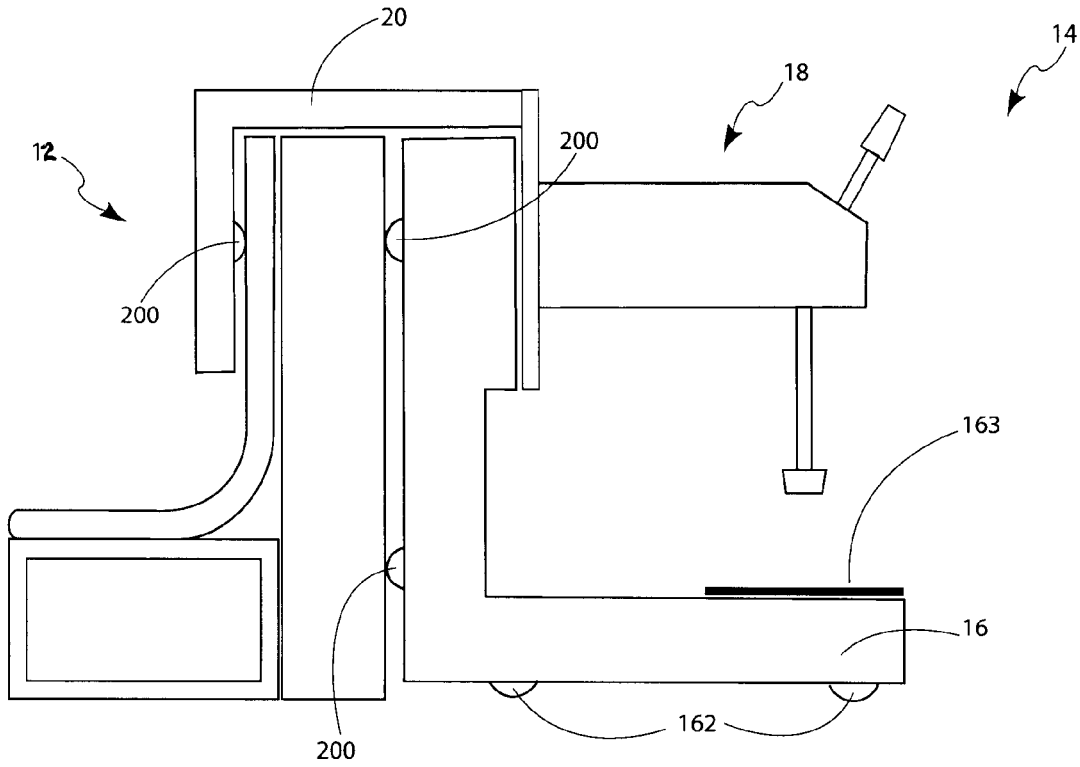
FIG. 3 is a front or rear view of an alternate embodiment to the apparatus depicted in FIG. 2.
Figure 11:
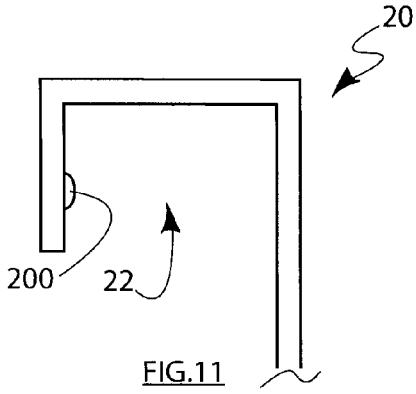
FIG. 11 is a front or rear view of one embodiment of the guide of the carrier assembly.
Figure 12:
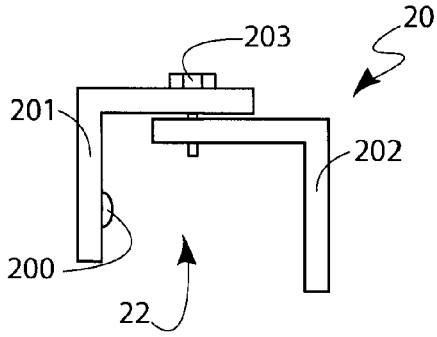
FIG. 12 is a front or rear view of another embodiment of the guide.

The guide 20 may comprise a single unit (see FIG. 11) having a plurality of rollers 200 therein for facilitating the motion of the guide 20 along the track formed by the extension 12. The rollers 200 may comprise roller (bearing) balls, or another suitable items (including wheels, skates or other types of rollers, in general) for achieving the goal of transporting the guide 20 along the track. In another embodiment, the guide 20 may comprise a two piece unit having angled portions 201 and 202 (see FIG. 12). The first portion 201 is coupled by a fastener 203 to the second portion 202, wherein the fastener 203 and the coupling of the portions 201 and 202 allows for adjustment and tightening if the guide 20 wears over time and usage. In either embodiment, the guide 20 may include anywhere from two to twelve rollers 200. The rollers 200 are envisioned as being located along the interior of the outmost portion of the guide 20, such as along the interior of angled portion 201 (in a two piece unit) or to the corresponding location of a single piece unit. It is also envisioned that rollers 200 may be provided on the rear surface of the upstanding member 161 of FIG. 2 and FIG. 9, respectively, or along the rear surface of the inner most portion of the guide 20, as depicted in FIG. 3 and FIG. 8, respectively, so as to provide rollers 200 on either side of the extension 14. The guide 20 may be formed of a variety of materials, including aluminum, plastic (such as PVC), or any other material suitable for such usage. The guide 20 may also include at least one handle 204 coupled or affixed thereon, providing the user with the ability to control the guide 20 during operation. It is envisioned that a plurality of handles 204 may be provided in a variety of locations or positions, including along a top surface of the guide 20, such as on the surface opposing the recess 22.

Figure 13:
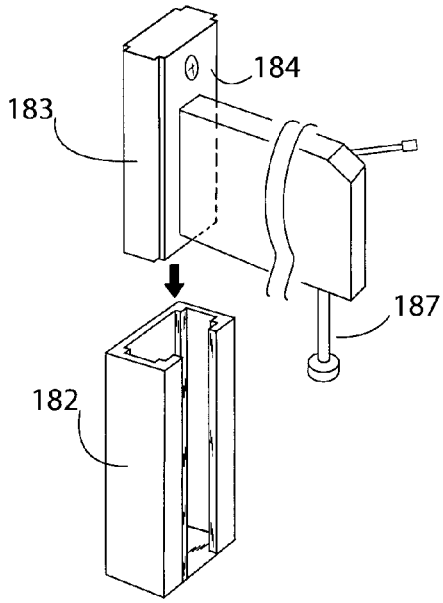
FIG. 13 is a perspective view of one embodiment of the clamp assembly.
Figure 14:
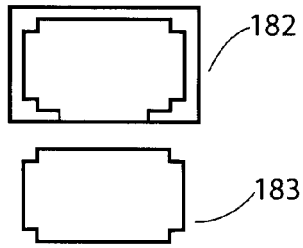
FIG. 14 is a top or bottom view of the channel bar and the slide bar.
Figure 15:
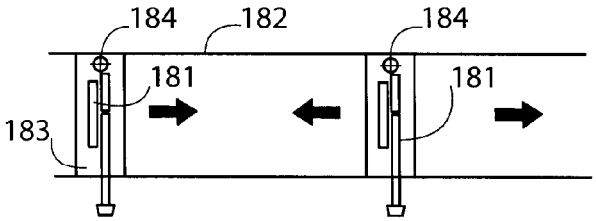
FIG. 15 is a front view of another embodiment of the channel bar and slide bar.
Figure 16:
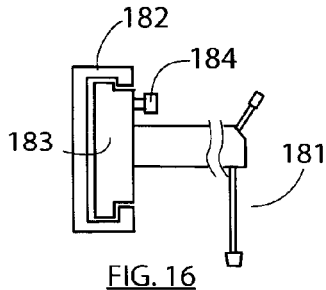
FIG. 16 is a side view of FIG. 16.

Each one of the clamp assemblies 18 has an arm 180 coupled to the guide 20 and has an adjustable clamp 181 at a free end. In another embodiment, and referring to FIG. 13 and FIG. 14, each one of the clamp assemblies 18 has a T-shaped channel bar 182 coupled to the guide 20, such as by attachment means (fastener, weld, adhesive, for example) and a complimentary T-shaped slide bar 183 removably coupled to the channel bar 182. Each clamp assembly 18 has a threaded fastener 184 for securing the slide bar 183 into a position, the slide bar 183 depending from one end of the arm 180 and opposite of the clamp 181. The fastener 184 is provided for adjustments of the each assembly 18. The fastener 184 may allow for vertical adjustments of each assembly 18 so that the height of the assembly 18 may accommodate a variety of thicknesses of material M, and thereby provide a more secure system for securing the material M to the sled 16. And, as depicted in FIG. 15 and FIG. 16, the fastener 184 may allow for horizontal or lateral adjustments of each assembly 18 so that the horizontal or lateral positioning may be adjusted to accommodate a variety of lengths of material M. In this embodiment, T-channel bar 182 and the T-shaped slide bar 183 are laterally or horizontally configured to accommodate lateral adjustments therein.

The clamp 181 of each assembly 18 may comprise a variety of forms or types. It is envisioned that one suitable type is an adjustable toggle clamp of the type depicted and described in U.S. Pat. No. 5,823,084, incorporated by reference as if rewritten herein. Another suitable clamp 181 is of the push-pull toggle clamps having a lever that urges the spindle up or down. A bumper is or may be coupled to the free end of the spindle, the bumper employed to reduce the potential for damaging the material M secured by the clamp 181. Other clamps known in the art are envisioned as suitable for incorporation and use into the basic apparatus described by this application.

It is envisioned that other elements or components may be incorporated into the basic apparatus described herein, including the use of means for aligning the material M in a manner that most efficiently utilizes the material, including the reduction of unnecessary waste of the material M. For instance, guide lines etched along the sled 16 (including the base element) may be employed so as to provide a visual indication as to where the user should align the material M. As another example, a laser or a laser generating system 24 may be utilized in which a laser line 240 is generated and cast onto the work area so that the user has a visual reference in which to align the material M. The laser or laser system may be placed along either end of the work station, or configured to be placed overhead and out of the way of the general work area.

Figure 19:
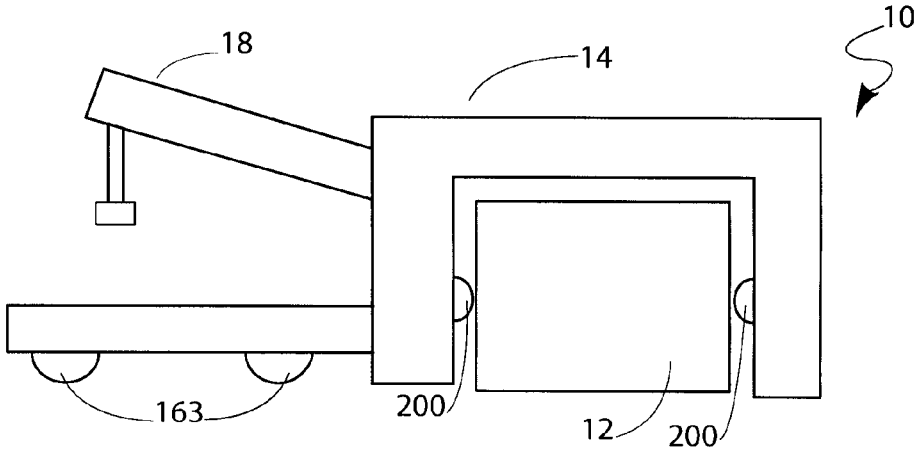
FIG. 19 is a side view of the embodiment depicted in FIG. 18 with the apparatus coupled to the extension.

In another alternate embodiment, the extension 12 comprises linearly elongated members 127 and 128, respectively. The members 127 and 128 are inserted into the respective open ends of the rip fence "F", thereby extending the length of the rip fence "F" along an axial direction substantially parallel to the saw blade "B". The members 127 and 128 provide a track upon which the carrier assembly 14 rests and travels along. In this embodiment, the carrier assembly 14 will have a lower profile in that the guide 20 will envelope the rip fence "F" and the assemblies 18 will be positioned lower along the guide 20 or the upstanding member 161 (if provided). The assemblies 18 may be angled (as depicted in FIG. 19 so as to accommodate material of various thicknesses.

In one embodiment, the dimensions of the particular elements may be varied to allow for ease of use and versatility from one work area plan to another. For instance, in one embodiment, the extension 12 has a length approximately nine (9) feet, but could be provided in a range of lengths from approximately four (4) feet up to approximately twelve (12) feet. The carrier assembly 14 may have a length of approximately six (6) feet, but could be provided in a range of lengths from approximately four (4) feet up to approximately eight (8) feet. A carrier assembly 14 of approximately four (4) feet in length could accommodate construction material of between six (6) and eight (8) feet. A carrier assembly 14 of approximately six (6) feet in length could accommodate material of between eight (8) and ten (10) feet. A carrier assembly 14 of eight (8) feet could accommodate material of between ten (10) and twelve (12) feet. The guide 20 will have a dimension approximately corresponding to the combined width of the extension 12, and accounting for the width of the roller(s).

What is claimed is:

1. An apparatus for straight-lining material comprising:

an extension coupled to a rip fence;

a carrier assembly coupled to the top of the extension, the carrier assembly traveling along the extension to deliver the material to a saw blade;

the carrier assembly comprising a sled, a plurality of clamp assemblies and a guide, the sled and the plurality of adjustable clamp assemblies coupled to the guide;

the guide having a recess receiving the extension; and each one of the plurality of clamp assemblies securing the material in position.

2. The apparatus of claim 1, wherein the extension has a pair of parallel and linearly elongated members and a plank intermediately disposed therebetween, the extension forming a track for the carrier assembly.

3. The apparatus of claim 2, wherein at least one of the elongated members has a minimal frictional resistance strip that engages the guide.

4. The apparatus of claim 1, wherein the extension comprises:

an angled member, a linearly elongated member and a plank intermediately disposed between the angled member and the linearly elongated member;

the angled member having a horizontal portion and a vertical portion, the horizontal portion coupled to the rip fence; and the extension forming a track for the carrier assembly.

5. The apparatus of claim 4, wherein at least one of the members has a minimal frictional resistance strip that engages the guide.

6. The apparatus of claim 1, wherein the recess has a plurality of rollers therein.

7. The apparatus of claim 1, wherein the guide has at least one handle coupled thereto.

8. The apparatus of claim 1, wherein the sled has a plurality of rollers on an underside of the sled.

9. The apparatus of claim 1, wherein the sled has a plurality of gripping surfaces mounted thereon and corresponding to the position of each one of the adjustable clamp units securing the material into position.

10. The apparatus of claim 1, wherein each one of the clamp assemblies has an arm coupled to the guide and having an adjustable clamp at a free end.

11. The apparatus of claim 10, wherein each one of the clamp assemblies further comprises:

a channel bar coupled to the guide; and a complimentary slide bar removably coupled to the channel bar, the slide bar having a threaded fastener for securing the slide bar into a vertical position and a horizontal position, the slide bar depending from an end of the arm and opposite of the adjustable clamp.

12. The apparatus of claim 1, wherein each one of the adjustable clamps comprises a toggle clamp assembly having the arm extending over the sled and a bolt assembly operatively coupled to the arm for securing the material in position.

13. The apparatus of claim 1, further comprising a laser assembly for generating a laser line by which the material may be aligned for cutting a straight-line edge.

14. An apparatus for straight-lining material comprising:

an extension coupled to a rip fence;

a carrier assembly coupled to the top of the extension, the carrier assembly traveling along the extension to deliver the material to a saw blade;

the carrier assembly comprising a sled, a plurality of clamp assemblies and a guide, the sled and the plurality of adjustable clamp assemblies coupled to the guide;

the guide having a recess and a plurality of rollers within the recess, the recess receiving the extension therein;

the sled having a base element coupled to an upstanding element, and a plurality of rollers on the underside of the base element; and each one of the plurality of clamp assemblies having an arm, the arm coupled to the guide and the upstanding element and having an adjustable clamp at a free end.

15. The apparatus of claim 14, wherein the extension has a pair of parallel and linearly elongated members and a plank intermediately disposed therebetween, the extension forming a track for the carrier assembly.

16. The apparatus of claim 15, wherein at least one of the elongated members has a minimal frictional resistance ship that engages the rollers of the guide.

17. The apparatus of claim 14, wherein the extension comprises:

an angled member, a linearly elongated member and a plank intermediately disposed between the angled member and the linearly elongated member;

the angled member having a horizontal portion and a vertical portion, the horizontal portion coupled to the rip fence; and the extension forming a track for the carrier assembly.

18. The apparatus of claim 17, wherein at least one of the members has a minimal frictional resistance strip that engages the rollers of the guide.

19. The apparatus of claim 14, wherein the guide comprises a single unit.

20. The apparatus of claim 14, wherein the guide comprises a first angled portion coupled with a second angled portion and forming the recess, the first angled portion and the second angled portion linearly elongated.

21. The apparatus of claim 20, wherein the first angled portion and the second angled portion are coupled by a fastener to allow for adjustments in the width of the recess.

22. The apparatus of claim 14, wherein the guide has at least one handle coupled thereto.

23. The apparatus of claim 14, wherein the sled has a plurality of gripping surfaces mounted thereon and corresponding to the position of each one of the adjustable clamp units securing the material into position.

24. The apparatus of claim 14, wherein each one of the clamp assemblies further comprises:

a channel bar coupled to the guide; and a complimentary slide bar removably coupled to the channel bar, the slide bar having a threaded fastener for securing the slide bar into a vertical position and a horizontal position, the slide bar depending from an end of the arm and opposite of the adjustable clamp.

25. The apparatus of claim 14, wherein each one of the adjustable clamps comprises a toggle clamp assembly having the arm extending over the sled and a bolt assembly operatively coupled to the arm for securing the material in position.

26. The apparatus of claim 14, further comprising a laser assembly for generating a laser line by which the material may be aligned for cutting a straight-line edge.

27. An apparatus for straight-lining material comprising:

an extension coupled to a rip fence;

a carrier assembly coupled to the top of the extension, the carrier assembly traveling along the extension to deliver the material to a saw blade;

the carrier assembly comprising a sled, a plurality of clamp assemblies and a guide, the sled and the plurality of adjustable clamp assemblies coupled to the guide;

the guide having a recess and a plurality of rollers within the recess, the recess receiving the extension therein;

the sled having a base element coupled to an upstanding element, and a plurality of rollers on the underside of the base element; and each one of the plurality of clamp assemblies having an arm, the arm coupled to the guide and the upstanding element at one end and having an adjustable clamp at an opposing end for securing the material in position, and each one of the plurality of clamp assemblies is laterally and vertically adjustable.

28. The apparatus of claim 27, wherein the extension has a pair of parallel and linearly elongated members and a plank intermediately disposed therebetween, the extension forming a track for the carrier assembly.

29. The apparatus of claim 28, wherein at least one of the elongated members has a minimal frictional resistance strip that engages the rollers of the guide.

30. The apparatus of claim 29, wherein the extension comprises:

an angled member, a linearly elongated member and a plank intermediately disposed between the angled member and the linearly elongated member;

the angled member having a horizontal portion and a vertical portion, the horizontal portion coupled to the rip fence; and the extension forming a track for the carrier assembly.

31. The apparatus of claim 30, wherein at least one of the members has a minimal frictional resistance strip that engages the rollers of the guide.

32. The apparatus of claim 27, wherein the guide comprises a single unit.

33. The apparatus of claim 27, wherein the guide comprises a first angled portion coupled with a second angled portion and forming the recess, the first angled portion and the second angled portion linearly elongated.

34. The apparatus of claim 33, wherein the first angled portion and the second angled portion are coupled by a fastener to allow for adjustments in the width of the recess.

35. The apparatus of claim 27, wherein the guide has at least one handle coupled thereto.

36. The apparatus of claim 27, wherein the sled has a plurality of gripping surfaces mounted thereon and corresponding to the position of each one of the adjustable clamp units securing the material into position.

37. The apparatus of claim 27, wherein each one of the clamp assemblies further comprises:

a channel bar coupled to the guide; and a complimentary slide bar removably coupled to the channel bar, the slide bar having a threaded fastener for securing the slide bar into a position, the slide bar depending from an end of the arm and opposite of the adjustable clamp.

38. The apparatus of claim 27, wherein each one of the adjustable clamps comprises a toggle clamp assembly having the arm extending over the sled and a bolt assembly operatively coupled to the arm for securing the material in position.

39. The apparatus of claim 27, further comprising a laser assembly for generating a laser line by which the material may be aligned for cutting a straight-line edge.

* * * * *